US005641302A

United States Patent [19]

Adams

[11] Patent Number: 5,641,302

[45] Date of Patent: Jun. 24, 1997

[54] ELECTRIC CONNECTOR HAVING GRIPPING SURFACES FOR ASSEMBLING CONNECTOR TO CABLE

[75] Inventor: Edward John Adams, Sheerness, United Kingdom

[73] Assignee: Weidmuller (Klippon Products) Limited, Sheerness, England

[21] Appl. No.: 411,749

[22] PCT Filed: Sep. 30, 1993

[86] PCT No.: PCT/GB93/02042

§ 371 Date: Apr. 19, 1995

§ 102(e) Date: Apr. 19, 1995

[87] PCT Pub. No.: WO94/08362

PCT Pub. Date: Apr. 14, 1994

[30] Foreign Application Priority Data

Sep. 30, 1992 [GB] United Kingdom ..... 9220575

[51] Int. Cl.[6] ..... H01R 4/24

[52] U.S. Cl. ..... 439/417; 439/716

[58] Field of Search ..... 439/412–414, 439/417, 715–716

[56] References Cited

U.S. PATENT DOCUMENTS

| | | | |
|---|---|---|---|
| 3,609,644 | 9/1971 | Seim . | |
| 3,772,635 | 11/1973 | Frey et al. . | |
| 3,858,158 | 12/1974 | Henn et al. . | |
| 3,910,672 | 10/1975 | Frantz . | |
| 4,340,270 | 7/1982 | Wilmes et al. . | |
| 4,428,115 | 1/1984 | Campbell et al. | 29/873 |
| 4,462,655 | 7/1984 | Campbell et al. . | |
| 4,789,354 | 12/1988 | Smith et al. | 439/395 |
| 4,993,966 | 2/1991 | Levy | 439/411 |
| 5,096,437 | 3/1992 | Levy | 439/411 |
| 5,149,278 | 9/1992 | Waas et al. | 439/412 |

FOREIGN PATENT DOCUMENTS

| | | | |
|---|---|---|---|
| 0055876 | 7/1982 | European Pat. Off. | H01R 4/24 |
| 0247360 | 12/1987 | European Pat. Off. | H01R 4/24 |
| 2902536 | 4/1980 | Germany | H01R 9/04 |
| 1463830 | 2/1977 | United Kingdom | H01R 15/38 |
| 2029650 | 3/1980 | United Kingdom | H01R 4/24 |
| 2034538 | 6/1980 | United Kingdom | H01R 4/24 |
| 2089147 | 6/1982 | United Kingdom | H01R 4/24 |
| 2122036 | 1/1984 | United Kingdom | H01R 4/24 |
| 2196492 | 4/1988 | United Kingdom | H01R 4/24 |
| WO92/15130 | 9/1992 | WIPO | H01R 4/24 |

*Primary Examiner*—David L. Pirlot
*Assistant Examiner*—Jill Demello
*Attorney, Agent, or Firm*—Greenblum & Bernstein P.L.C.

[57] ABSTRACT

An electrical connector that includes an electrical contact, a first housing adapted to receive the contact, and a second housing adapted to receive a cable. The configuration of the first and second housings and the contact are such that, during assembly of the connector, the second housing guides the cable to abut the contact in such a manner that the contact displaces an insulating layer of the cable and forms an electrical connection with a wire core of the cable. The first housing has a first gripping surface and the second housing has a second gripping surface, the gripping surfaces being arranged to face away from each other and to face perpendicularly to the longitudinal axis of the cable prior to assembly, such that the surfaces can be gripped by a thumb and forefinger and squeezed together to effect assembly.

13 Claims, 8 Drawing Sheets

ELECTRIC CONNECTOR HAVING GRIPPING SURFACES FOR ASSEMBLING CONNECTOR TO CABLE

BACKGROUND OF THE INVENTION

1. Field of the Invention

The present invention relates to an electric connector of the type which retains an end portion of an electric wire and forms an electrical connection with the end portion of the wire, so as to electrically connect the wire with some other electric component. Particularly, the invention relates to the type of electric connector in which the electrical connection between the end portion of the wire and the connector is made by the act of inserting the end portion of the wire into part of the connector, thereby obviating the need for pre-stripping the wire.

2. Description of Background and Relevant Information

Conventional electric connectors of this type are known from, for example, EP (UK) 0 247 360 and U.S. Pat. No. 3,910,672. Each of these documents shows a connector by means of which electric conductors are connected by insulation-displacing and connecting pieces which are located within a housing. However, the wires are fitted and removed, in each case, by using a manual tool. Although such an arrangement provides a successful connector, the use of the tool can waste time, due to problems of manipulation and also because the connectors cannot be assembled or dismantled if the tool is not at hand. U.S. Pat. No. 4,993,996 discloses a prior art connector. In the disclosed arrangement a connector block includes a housing provided with plural apertures and individual terminal modules for insertion into the housing. Each module is first inserted into the housing and a wire is subsequently inserted into the module. Electrical connection of the wire is achieved after insertion by tightening a bolt situated on an outer surface of the module, so as to force the wire into contact with a conductor.

SUMMARY OF THE INVENTION

The present invention sets out to provide a connector which allows electric wires to be connected to electric equipment without using any additional manual tools.

According to the invention there is provided an electric connector comprising an electric contact, a first housing adapted to receive the said contact and a second housing adapted to receive a cable;

the configuration of the first and second housings and the contact being such that, during assembly of the connector, the second housing can guide the cable to abut the contact in such a manner that the contact displaces an insulating layer of the said cable and forms an electrical connection with a wire core of the cable, characterized in that the first housing comprises a first gripping surface and the second housing comprises a second gripping surface, which gripping surfaces are adaptated to be arranged to face away from each other and face perpendicularly to the longitudinal axis of the cable prior to assembly, such that they can be gripped by a thumb and forefinger and squeezed together to effect assembly.

Preferably, the first housing comprises a female formation and the second housing comprises a male formation. The second housing may comprise an aperture for receiving and guiding the cable, a guide means for urging the cable against the contact is preferably also provided on the second housing.

The contact may be generally tubular and comprise a contact arm extending from its perimeter. Advantageously, the contact will also comprise a slit, into which the cable is guided by the second housing. The slit may be tapered in such a way that it serves to bite into the insulation of the cable, as the cable is inserted in order to eventually contact the inner wire core of the cable.

The first and second housing may optionally be configured to define, once fitted together, a sleeve to surround the contact arm of the contact. This sleeve can be used as a male formation for insertion into another component, to form a contact.

BRIEF DESCRIPTION OF THE DRAWINGS

An embodiment of the invention will now be described, by way of example, and with reference to the accompanying drawings in which.

DETAILED DESCRIPTION OF THE PREFERRED EMBODIMENTS

Figure 1:
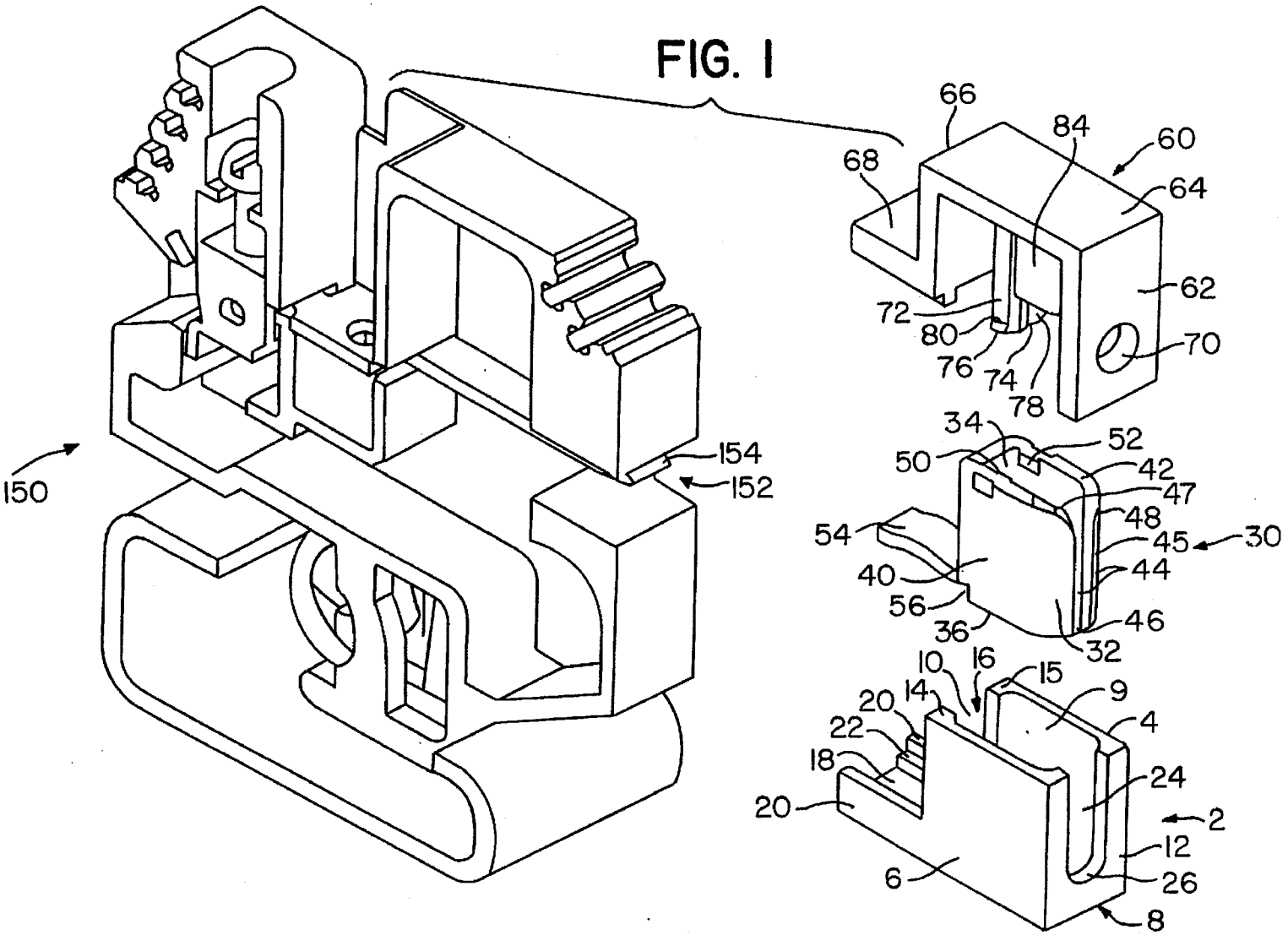
FIG. 1 is an exploded, perspective view of a connector according to the present invention and a terminal block.
Figure 4:
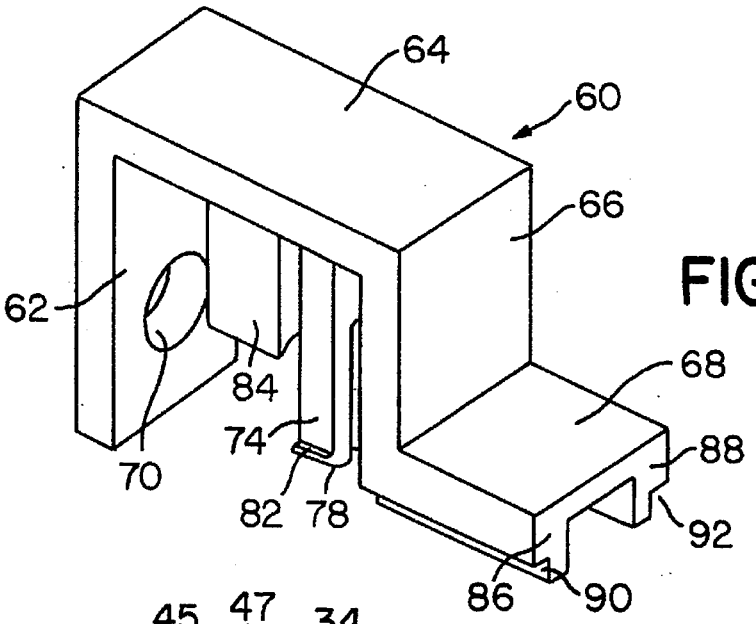
FIG. 4 shows a male housing of the connector of FIG. 1, as viewed from the opposite direction.
Figure 3:
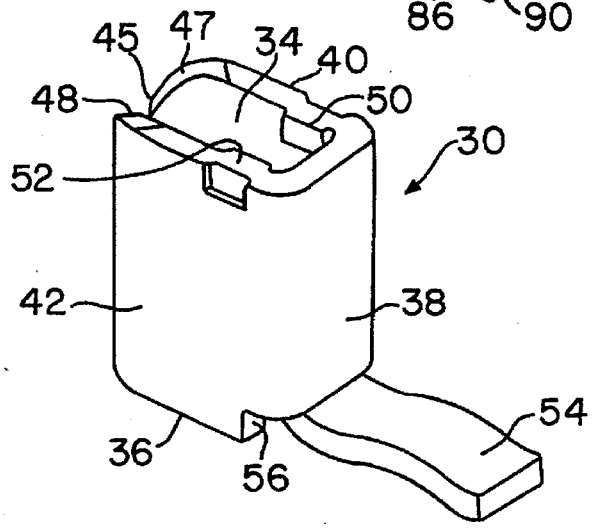
FIG. 3 shows a wire receiving contact of the connector shown in FIG. 1, as viewed from the opposite direction.
Figure 2:
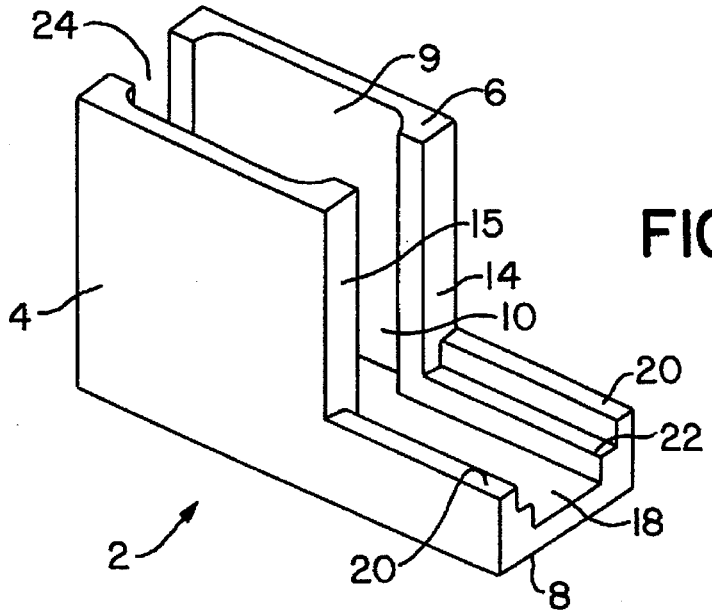
FIG. 2 shows a female housing of the connector shown in FIG. 1, as viewed from the opposite direction.

The connector comprises three primary components: namely a plastic female housing 2; a wire receiving metal contact 30, which fits within the female housing; and a plastic male housing 60, which receives a cable, fits within the wire receiving contact and closes the arrangement. The connector can be inserted (see below) into a terminal block 150, so as to connect the electric cable with the electric equipment connected with the terminal block 150.

The female housing 2 of the connector 100 is generally rectangular in cross-section and comprises two side walls 4, 6 and one end wall 8.

Side 10 is open from one end 8 to the other end 9 and includes a pair of lips 14, 15 which extend parallel to the face of the side 10, so as to define a slit 16. Extending outwardly from the channel 16 and parallel to the closed end face 8 of the female housing, is a projection 18, which serves as part of a contact sleeve (see below). Projection 18 comprises a pair of side walls 20 which extend along the length of the projection 18, so as to be outwardly co-planar with the walls of the closed sides 4 and 6 of the female housing. Situated directly adjacent each side wall 20 is an elongate step 22, which extends parallel to the respective side wall 20 for the entire length of the projection 18. An elongate aperture 24 is situated in the opposite side 24 of the female housing 2. The aperture 12 extends from the open end 9 of the female housing towards the closed end 8 of the female housing, and terminates just short of the closed end 9 of the female housing to define an arcuate edge 26.

A wire receiving contact 30 is configured to fit closely within the female housing 2 of the connector. The wire receiving contact 30 is formed primarily by a tubular body 32, which is open at each end. The tubular body comprises one flat side 38 and two sides 40 and 42 which are each "j" shaped in cross-section. When viewed in cross-section, the straight end of each "j" is connected perpendicularly to a respective edge of the said flat side 38, whilst the curved ends of the "j"s tend towards each other. The curved ends are angled such at an inner corner of each of the sides 40 and 42 oppose each other, so as to form a pair of cutting edges with a slit 46 between them. The cutting edges and slit 46 make up the fourth "side" of the tubular body 32.

The cutting edges are parallel at the first end 36 of the tubular body 32 and continue so until close to the second end 34 of the tubular body; from there onwards the width of the slit increases towards the second end 34 of the tubular body, to define a pair of arcuate insulation-displacing regions 47, 48. A pair of projections 50, 52 are provided on side walls 40 and 42 of the contact adjacent the second end 34. These projections are directed into the interior of the tubular body 32.

A contact arm 54 extends perpendicularly outwardly from the side face 38, in a region close to the first open end 36 of the tubular body 32. The contact arm is slightly "S"-shaped in profile and has a width almost equal to that of the side face 38 and is formed integrally with the tubular body 32. The curvature of the profile of the contact arm is such that the arm joins the closed side face 38 in a direction parallel to the side face 38. Between the junction of the contact arm 54 and the side face 38 and the first end 36 of the tubular body, the sloe face 38 is cut away to define a recess 56. The sides 40 and 42 of the tubular body 32 are also recessed adjacent the recess 56 so as to form an overhanging lip.

The male housing portion 60 is formed from four flat walls connected together so as to generally define a rather square question mark-shape in profile. A first side wall 62 comprises a circular aperture 70. Side wall 62 is perpendicularly connected to end wall 64. A pair of tongues 72, 74 depend from end wall 64 and can flex resiliently. The distal end of each tongue 72, 74 is formed with an inclined surface 76, 78 and a tooth 80, 82 which projects generally perpendicularly to the longitudinal axis of the tongue. A cable seating portion 84 also depends from the inwardly directed side of wall 64 and is located between the tongues 72, 74 and side wall 62. The distal surface of the cable seating portion 84 is concavely arcuate and is configured to correspond in position and diameter and curvature with the perimiter of the circular aperture 70.

Wall 68 of the male housing extends generally parallel to the wall 64 and is perpendicularly connected to wall 66, which is interposed between walls 68 and 64. The length of wall 66 is shorter than that of wall 62, thereby causing wall 68 to extend from a position located somewhat closer to wall 64 than is the distal end of wall 62. Wall 68 defines the remaining part of the cable sleeve, which is partly defined by projection 18, and is provided with a pair of ridges 86 and 88 which are configured to mate with the side walls 20 extending along the length of projection 18. Each of the ridges 86 and 88 extends generally perpendicularly from the face of the wall 68 and entirely along the length of the wall 68. In the outwardly directed region of each ridge 86, 88, a rebate 90, 92, having a generally rectangular cross-section, is formed. Each rebate 90, 92 is configured to receive a respective one of the side walls 20 provided on projection 18. Terminal block 150 comprises a recess 152, in which is situated a contact arm 154. The configuration of the recess 152 is such as to receive and securely support the cable sleeve, formed by projection 18 and wall 68 of the connector 100.

Contact arms 54 and 154 are formed such that at least one of them is resiliently urged towards the other. Contact 54 will, after construction of the connector, be situated in the lower region of the contact sleeve, as viewed in FIG. 5. When the contact sleeve is inserted into the terminal block, the contact arm 54 will abut the underside of the contact arm 154. The curvature of contact arm 54 will cause the arm 54 to be deflected downwardly, whilst maintaining-contact with the underside of arm 154, due to the resilience of arm 54. This will ensure that a good electrical connection is made between the two contacts 54 and 154 and also serve to retain the cable sleeve within the recess 152, thus reducing the likelihood that the circuit will be accidentally broken.

Providing that some form of electrical connection is made with the contact 154 in order to complete the circuit, the remaining features of the terminal block can be formed according to any specific requirements.

Figure 5:
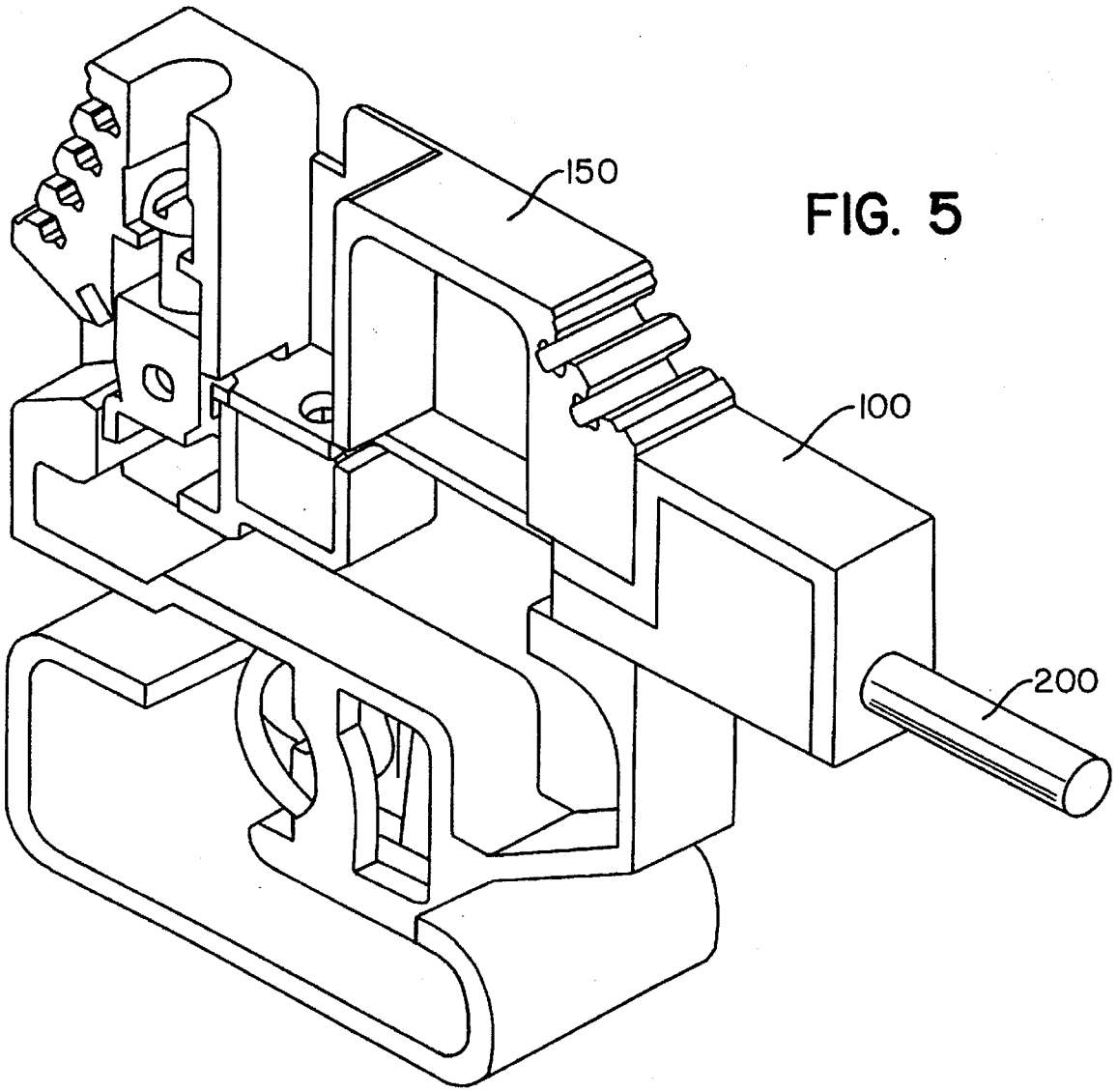
FIG. 5 shows the connector of FIGS. 1 to 4 when fitted into the terminal block of FIG. 1 to form a connection for a cable.

The terminal block 150 shown in FIGS. 1 and 5 has a recess 152 for receiving a single connector 100 at any one time. The connector is inserted from the side of the terminal block 150.

Figure 6:
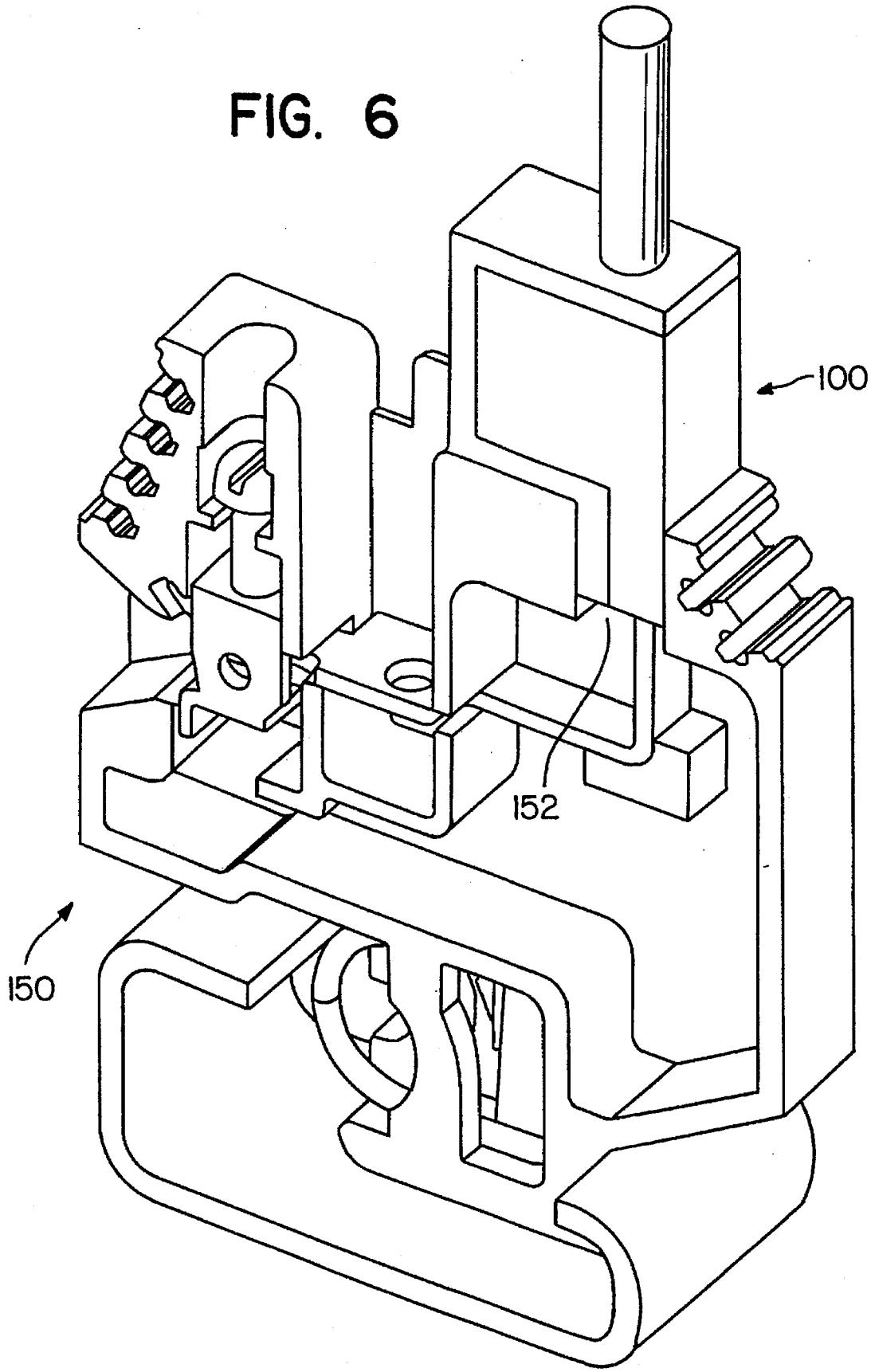
FIG. 6 shows the connector of FIGS. 1 to 4 when fitted into another terminal block.
Figure 7:
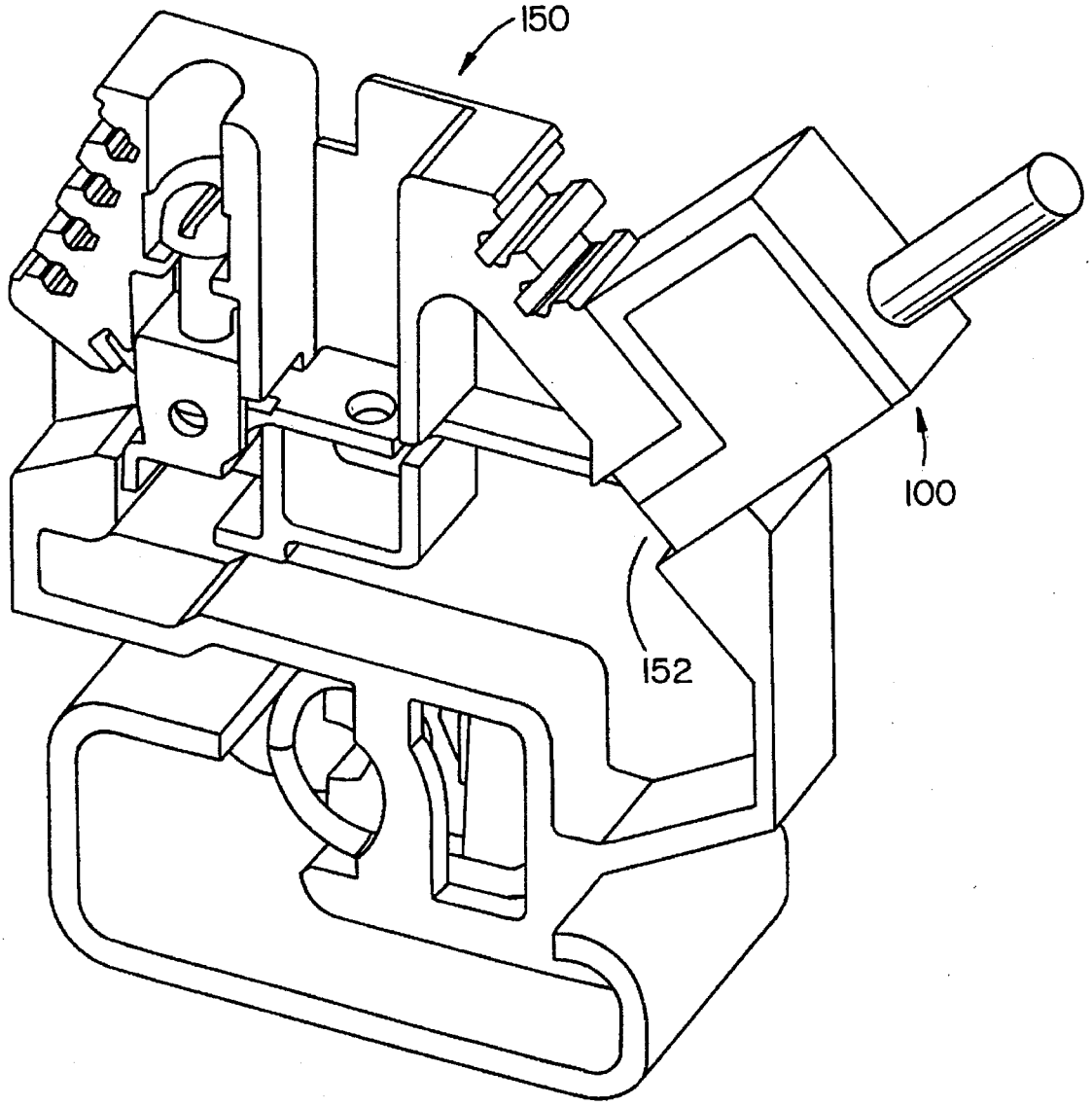
FIG. 7 shows the connector of FIGS. 1 to 4 when fitted into yet another terminal block.

FIGS. 6 and 7 show variations of the terminal block 150 in which a recess 152 for receiving the connector 100 is situated at the top of the block 150 and at an angle of 45° to the horizontal, respectively.

Figure 8:
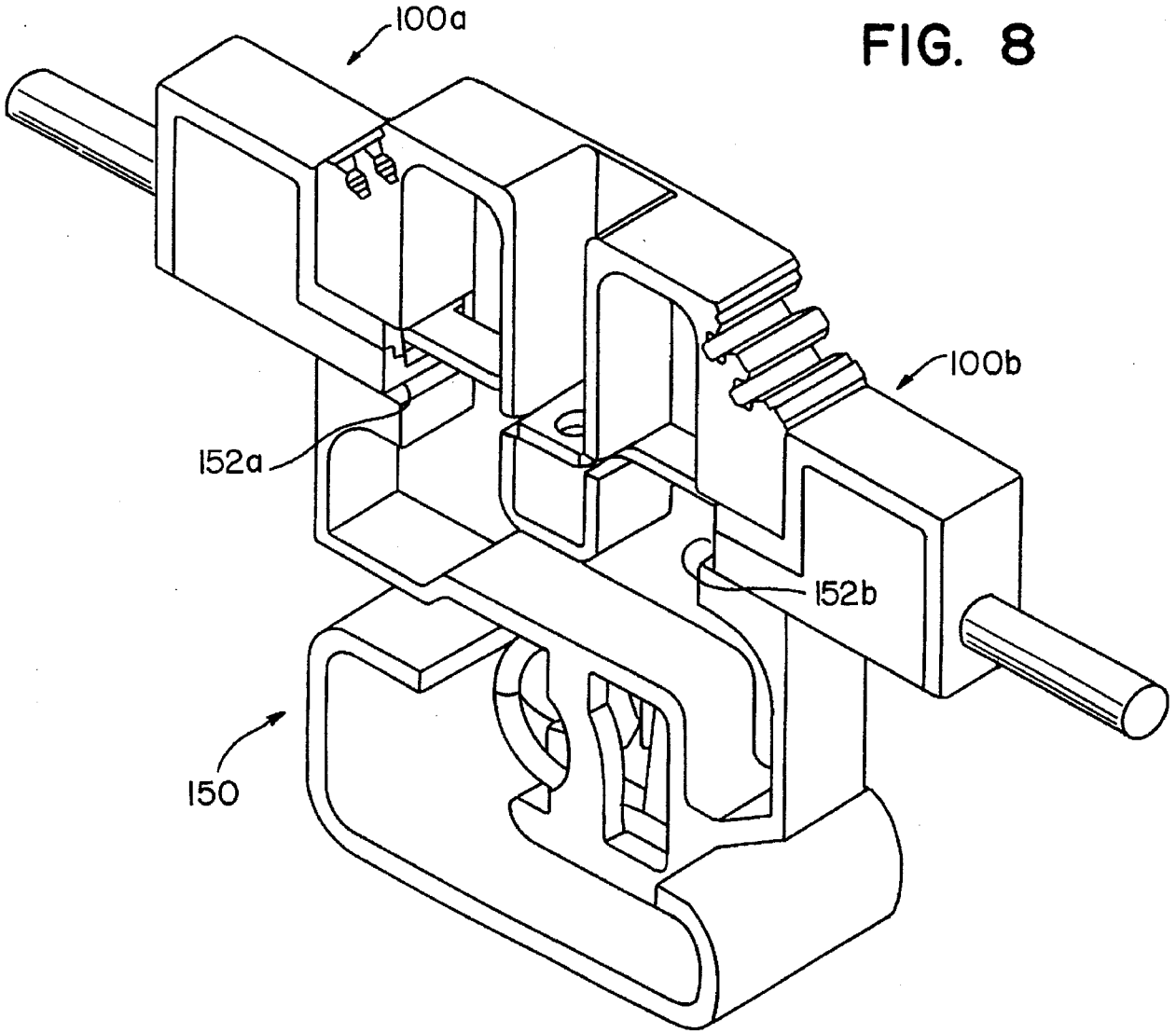
FIG. 8 shows another terminal block, accommodating two connectors such as the one shown in FIGS. 1 to 4.
Figure 9:
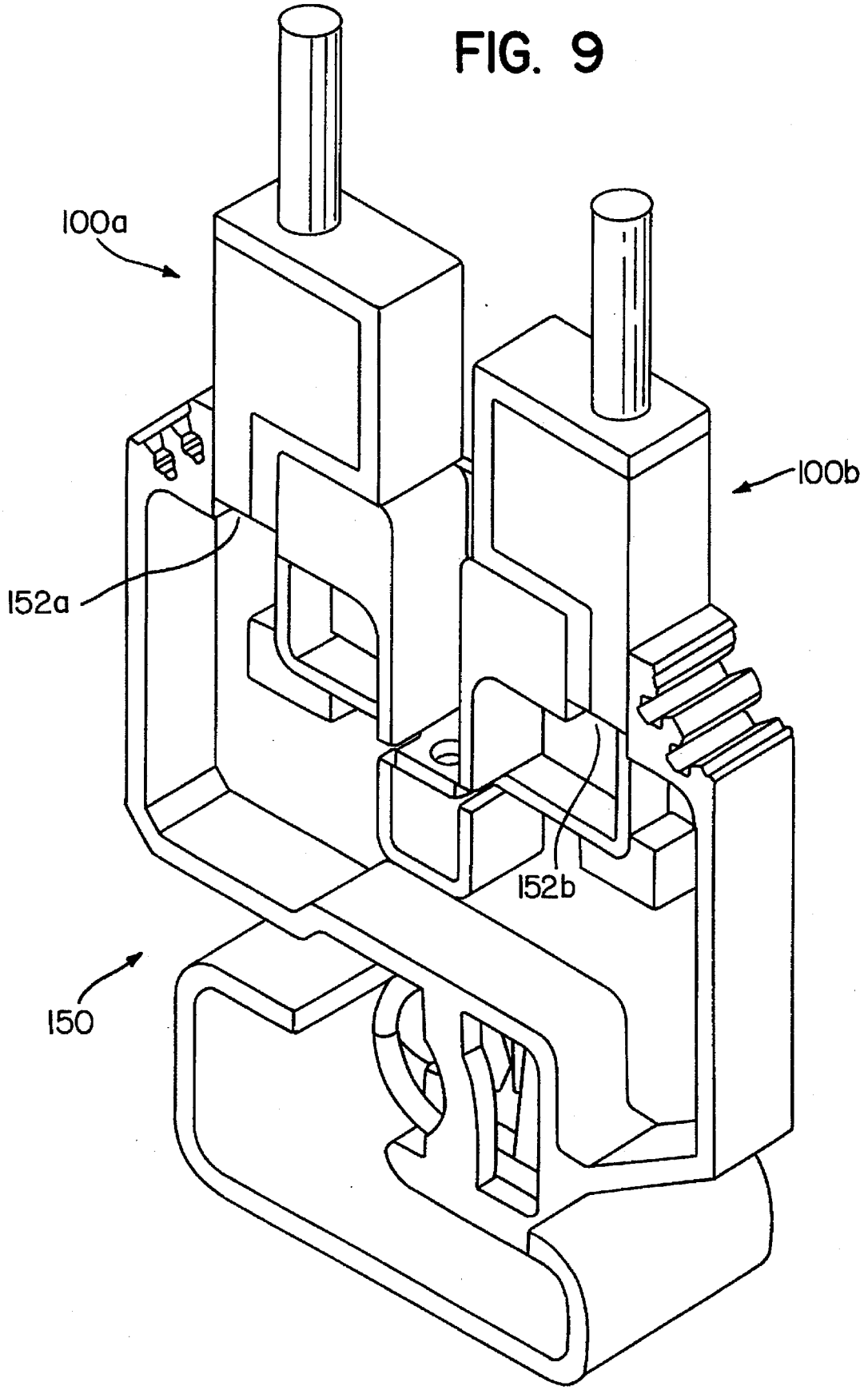
FIG. 9 shows another terminal block, accommodating two connectors such as the one shown in FIGS. 1 to 4.
Figure 10:
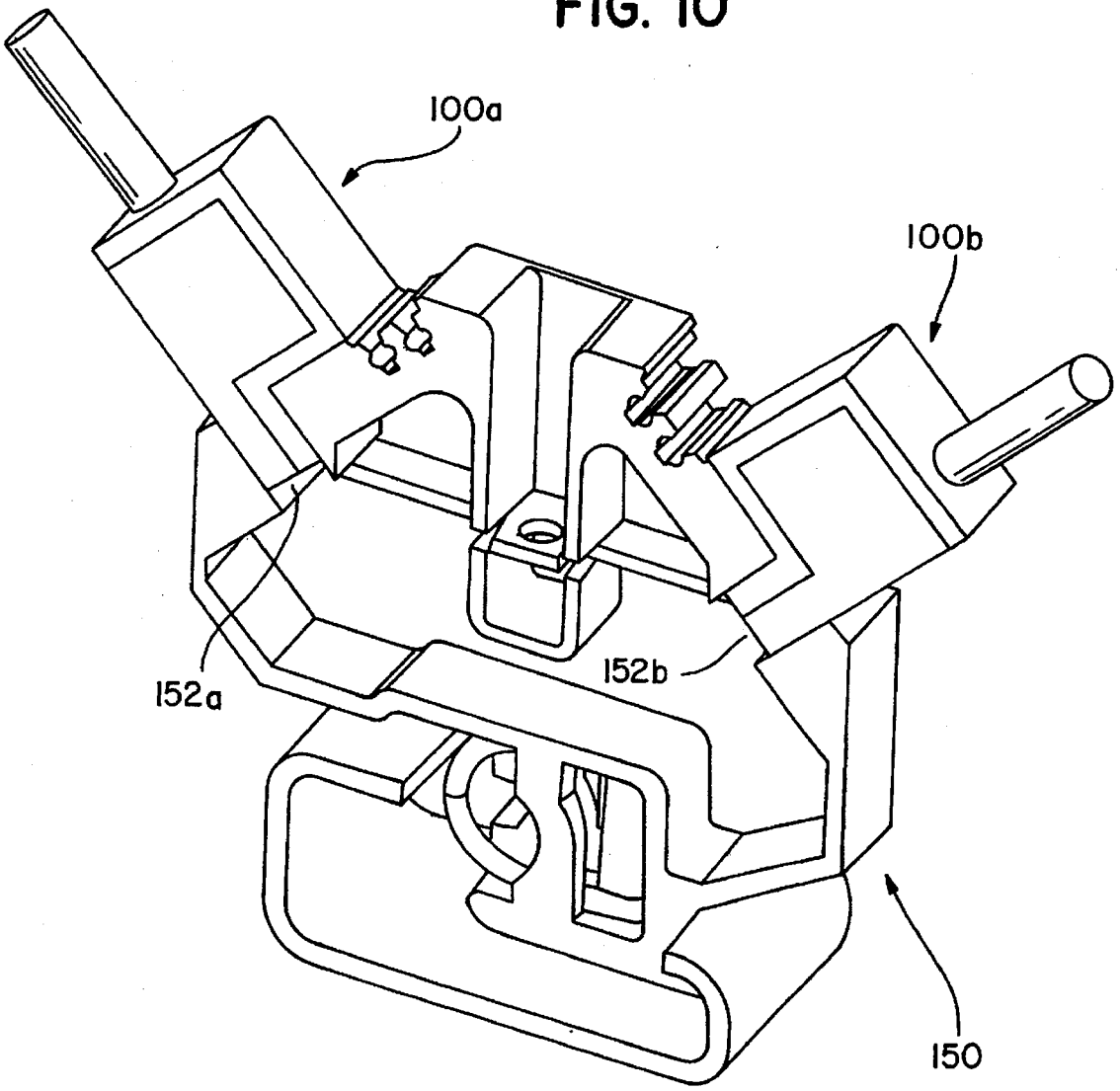
FIG. 10 shows another terminal block, accommodating two connectors such as the one shown in FIGS. 1 to 4.

The terminal block I50 can be configured to accommodate more than one connector 100 at any one time. FIGS. 8, 9 and 10 show respective terminal blocks which each comprise two recesses **152*a*, 152*b*, thus enabling the block to receive two connectors 100 simultaneously. FIG. 8 shows a terminal block 150 which accommodates two connectors 100*a*, 100*b* simultaneously on opposite sides. FIG. 9 shows a terminal block which has two recesses 152*a*, 152*b* situated at the top, to enable two connectors 100 to be inserted simultaneously into the top of the block. FIG. 10 has two recesses 152*a*, 152*b***, each sitated at 45° to the horizontal.

It is, of course, possible to configure the terminal block 150 to enable it to receive three or more connectors. Furthermore, the recesses 152 may be arranged so that connectors 100 can be inserted from different angles, e.g. one from the top and one from the side. During manufacture, the cable receiving contact 30 is installed within the female housing 2, with contact arm 54 projecting through the open side 10 of the housing in such a manner as to extend between the side walls 20 of the projection The flexible tongues 72, 74 of the male housing are then inserted into the wire receiving contact 30. The inclined faces 76, 78 of the tongues allow them to slip past projections 50, 52 and on into the contact 30. Once this has been done, the teeth 80, 82 abut the projections if the male housing is pulled back out and thereby retain the tongues 72, 74 within the contact, thus holding these parts of the connector together.

To use the connector, a cable 200 is inserted through the circular aperture 70 of the male housing 60. The cable 200 is inserted so that at least part of it comes to rest in juxtaposition with the arcuate surface of the cable seating portion 84.

The male housing and female housing can then be pressed together using a finger and thumb. As this is done, the tongues 72, 74 and side walls 66 and 62 of the male housing 60 serve to guide the housing 60 as it is inserted to the female housing 2. As the two parts of the connector are brought together, the cable 200 initially abuts the insulation-displacing regions 47 and 48. As the cable 200 is moved further into the female housing by the male housing, it enters a region where the separation between the insulation-displacing cable regions 47, 48 of the cutting edges is narrower. The result of this is that, as the cable is urged even further, the insulation-displacing cable regions of the cutting edges begin to bite into the insulation of the cable. Eventually the sides of the slit 46 will contact the wires running within the cable 200.

Once the connector 100 has been assembled in this manner, the cable sleeve can be inserted into the recess 152 of the terminal block 150. When this is done, contact arms 54 and 154 connect and the electrical connection is made. The recess 152 of the terminal block serves to hold the connector together, once it has been inserted, since the two housings 2, 60 cannot be separated once fitted into the terminal block.

Although the foregoing embodiment shows a male connecting portion (in the form of the cable sleeve) to be formed on the connector 100, and a female connecting portion (in the form of the recess 152) to be formed in the terminal block 150, a reverse arrangement, in which a recess is provided in the connector and a projection is provided on the terminal block 150, could also work successfully. Many further modifications and adaptations of the present invention will become apparent to those versed in the art upon making reference to the foregoing illustrative example, which is not intended to limit the scope of the invention.

What is claimed is:

1. An electrical connector comprising:

an electrical contact having an insulation engaging and displacing structure adapted to engage insulation of an electrical cable and to displace the insulation during assembly of the electrical connector;

a first housing adapted to receive the electrical contact;

a second housing adapted to receive the electrical cable, said second housing being adapted to be assembled to said first housing and said electrical contact to effect assembly of the electrical connector;

said second housing having a cable guiding portion for guiding the cable to be engaged with said electrical contact insulation engaging and displacing structure for displacement of the insulation for securing an electrical connection between said electrical contact and a wire core of the electrical cable; and said first housing having a first gripping surface and said second housing having a second gripping surface, said gripping surfaces being arranged to face away from each other and to face perpendicularly to the longitudinal axis of the electrical cable prior to assembly, for facilitating gripping of said gripping surfaces by a thumb and forefinger and squeezing said gripping surfaces together to effect assembly of the electrical connector.

2. An electrical connector according to claim 1, wherein:

said first housing comprises a female formation and said second housing comprises a male formation, said male formation being adapted to be inserted within said female formation while the electrical cable is connected to said male formation.

3. An electrical connector according to claim 1, wherein:

said second housing comprises an aperture for receiving the electrical cable and directing the electrical cable to be received by said receiving portion of said second housing for positioning the electrical cable during the assembly of the electrical connector.

4. An electrical connector according to claim 1, wherein:

said cable guiding portion of said second connector comprises a seat for supporting the electrical cable during the assembly of the electrical connector.

5. An electrical connector according to claim 1, wherein:

said electrical contact comprises a generally tubular body, said insulation engaging and displacing structure of the electrical contact comprising a slit formed by a pair of lips extending along a side of said tubular body, said electrical contact being received within said first housing prior to assembly of said first housing with said second housing, whereby, during the assembly of the electrical connector, the electrical cable is guided between said pair of lips of said slit by means of pressure applied against said gripping surfaces by the thumb and forefinger for forming an electrical connection between the inner core of the electrical cable and said electrical contact.

6. An electrical connector according to claim 5, wherein:

said slit comprises a flared end for receiving the electrical cable during the assembly of the electrical connector.

7. An electrical connector according to claim 6, wherein:

at least one of said lips at said flared end of said slit defines a cutting edge for biting into, and thereby displacing, the insulation of the electrical cable guided between said lips of said slit.

8. An electrical connector according to claim 1, wherein:

said electrical contact further comprises an electrically conductive projecting arm.

9. An electrical connector according to claim 8, wherein:

said first housing and said second housing comprise sleeve portions that, when the electrical connector is assembled, comprise a sleeve surrounding said projecting arm of said electrical contact.

10. An electrical connector according to claim 9, wherein:

said sleeve is configured to serve as a male formation adapted to be inserted into an assembly with which said projecting arm is to form an electrical connection.

11. An electrical connector comprising:

an electrical contact having an insulation engaging and displacing structure adapted to engage insulation of an electrical cable and to displace the insulation during assembly of the electrical connector;

a first housing adapted to receive the contact;

a second housing adapted to receive the electrical cable, said second housing being adapted to be assembled to said first housing and said electrical contact to effect assembly of the electrical connector;

said second housing having a cable guiding portion for guiding the cable to be engaged with said electrical contact insulation engaging and displacing structure for displacement of the insulation for securing an electrical connection between said electrical contact and a wire core of the electrical cable;

said first housing having a first gripping surface and said second housing having a second gripping surface, said gripping surfaces being arranged to face away from each other and to face perpendicularly to the longitudinal axis of the electrical cable prior to assembly, for facilitating gripping of said gripping surfaces by a thumb and forefinger and squeezing said gripping surfaces together to effect assembly of the electrical connector; and means for adapting the electrical connector for connection with a terminal block.

12. A terminal block comprising:

an electrical connector portion adapted to be electrically connected to an electrical connector, wherein the electrical connector comprises:

an electrical contact having an insulation engaging and displacing structure adapted to engage insulation of an electrical cable and to displace the insulation during assembly of the electrical connector;

a first housing adapted to receive the contact;

a second housing adapted to receive the electrical cable, said second housing being adapted to be assembled to said first housing and said electrical contact to effect assembly of the electrical connector;

said second housing having a cable guiding portion for guiding the cable to be engaged with said electrical contact insulation engaging and displacing structure for displacement of the insulation for securing an electrical connection between said electrical contact and a wire core of the electrical cable;

said first housing having a first gripping surface and said second housing having a second gripping surface, said gripping surfaces being arranged to face away from each other and to face perpendicularly to the longitudinal axis of the electrical cable prior to assembly, for facilitating gripping of said gripping surfaces by a thumb and forefinger and squeezing said gripping surfaces together to effect assembly of the electrical connector; and means for adapting the electrical connector for connection with a terminal block.

13. An electrical connector comprising:

an electrical contact having an insulation engaging and displacing structure adapted to engage insulation of an electrical cable and to displace the insulation during assembly of the electrical connector;

a first housing adapted to receive the electrical contact;

a second housing adapted to receive the electrical cable, said second housing being adapted to be assembled to said first housing and said electrical contact to effect assembly of the electrical connector;

said second housing having a cable guiding portion for guiding the cable to be engaged with said electrical contact insulation engaging and displacing structure for displacement of the insulation for securing an electrical connection between said electrical contact and a wire core of the electrical cable; and said first housing having a first gripping surface and said second housing having a second gripping surface, said gripping surfaces being arranged to face away from each other and to face perpendicularly to the longitudinal axis of the electrical cable prior to assembly, said gripping surfaces comprise means for enabling engagement of said first gripping surface and said second gripping surface by a thumb and forefinger, respectively, and for squeezing said gripping surfaces together to effect assembly of the electrical connector.

* * * * *